US008111237B2

(12) United States Patent
Yamagishi

(10) Patent No.: US 8,111,237 B2
(45) Date of Patent: Feb. 7, 2012

(54) LIQUID CRYSTAL DISPLAY AND METHOD OF DISPLAYING THEREOF

(75) Inventor: Nobuyasu Yamagishi, Minami-Ashigara (JP)

(73) Assignee: Fujifilm Corporation, Minato-Ku, Tokyo (JP)

( * ) Notice: Subject to any disclaimer, the term of this patent is extended or adjusted under 35 U.S.C. 154(b) by 717 days.

(21) Appl. No.: 12/293,937

(22) PCT Filed: Mar. 22, 2007

(86) PCT No.: PCT/JP2007/056754

§ 371 (c)(1),
(2), (4) Date: Sep. 22, 2008

(87) PCT Pub. No.: WO2007/111363

PCT Pub. Date: Oct. 4, 2007

(65) Prior Publication Data

US 2009/0237347 A1 Sep. 24, 2009

(30) Foreign Application Priority Data

Mar. 22, 2006 (JP) ..... 2006-079191

(51) Int. Cl.
*G09G 3/36* (2006.01)

(52) U.S. Cl. ..... 345/102; 345/87; 345/204; 345/690

(58) Field of Classification Search ..... 345/55, 345/84, 87, 102, 204, 690; 315/149, 158
See application file for complete search history.

(56) References Cited

U.S. PATENT DOCUMENTS

| | | | | |
|---|---|---|---|---|
| 7,256,763 | B2 * | 8/2007 | Kaneki et al. | 345/102 |
| 7,592,981 | B2 * | 9/2009 | Maeda | 345/76 |
| 7,773,065 | B2 * | 8/2010 | Kumamoto | 345/87 |
| 2002/0047818 | A1 | 4/2002 | Yamamoto et al. | |
| 2002/0057238 | A1 | 5/2002 | Nitta et al. | |
| 2002/0154088 | A1 | 10/2002 | Nishimura | |

FOREIGN PATENT DOCUMENTS

| | | | |
|---|---|---|---|
| JP | 2001-042282 | A | 2/2001 |
| JP | 2001-268603 | A | 9/2001 |
| JP | 2001-331156 | A | 11/2001 |
| JP | 2002-091400 | A | 3/2002 |
| JP | 2002-156950 | A | 5/2002 |
| JP | 2002-323876 | A | 11/2002 |

OTHER PUBLICATIONS

PCT/ISA/210 (International Search Report).
PCT/ISA/237 (Written Opinion).

* cited by examiner

*Primary Examiner* — My-Chau T Tran
(74) *Attorney, Agent, or Firm* — Buchanan Ingersoll & Rooney PC

(57) ABSTRACT

A liquid crystal display includes: a liquid crystal panel; a backlight; an image move speed detection unit that detects the move speed of a display image, which is displayed on the liquid crystal panel; a black insertion percentage setting unit that sets black insertion percentage to produce black display according to liquid crystal response on the liquid crystal panel based on the move speed of the display image detected by the image move speed detection unit; and a backlight drive circuit that changes the luminance of the backlight in response to the black insertion percentage.

12 Claims, 12 Drawing Sheets

PRIOR ART

LIQUID CRYSTAL DISPLAY AND METHOD OF DISPLAYING THEREOF

TECHNICAL FIELD

This invention relates to a liquid crystal display and a method of displaying thereof and in particular to an active matrix liquid crystal display and a method of displaying thereof intended for improving moving image display performance.

BACKGROUND ART

In recent years, the uses of a liquid crystal display using a liquid crystal panel have been increased to a large-screen TV with upsizing of the board size and improvement in the manufacturing technologies such as a decreasing technology of the defective density as well as large improvement of the display performance because of improvement of contrast and viewing angle dependency. The large-screen TV use assumes moving image display and the image move distance per unit time increases with upsizing of the screen and thus excellent moving image performance is required. Further, blurring at the moving image display time becomes still more conspicuous because of high resolution based on high-definition TV of broadcast video. Still more excellent moving image performance will be required in the future (high-definition TV will become serious).

However, the liquid crystal panel involves a problem in the moving image performance because of the following major causes:

The first cause is as follows: The response speed indicating the time interval between the rising start of a liquid crystal molecule and the rising completion and the time interval between the falling start and the falling completion is low (a dozen or so ms). The liquid crystal panel produces display using a phenomenon in which the arrangement state of liquid crystal molecules changes in response to the applied voltage. Therefore, the changing speed of the arrangement state of liquid crystal molecules restricts the change speed of the display state.

The second cause is as follows: The display system is hold display of keeping given luminance constant for the duration of one display field for display (active matrix type of hold display is used for liquid crystal TV) and thus a feeling of physical disorder occurs for the visual appreciation of a human being as compared with impulse display like a CRT (Cathode Ray Tube) and an image is blurred. FIG. 12A shows the response waveform of a general liquid crystal panel and FIG. 12B shows the response waveform of a general CRT. FIGS. 12A and 12B show the case where white display is produced for the duration of four display fields in black display.

Measures against the first cause are as follows: Optimization is implemented in such a manner that liquid crystal material is put into low viscosity to allow liquid crystal molecules to easily move or that the liquid crystal cell gap is narrowed for enhancing the electric field strength, and an OCB (optical compensated bent) mode of placing the arrangement of liquid crystal molecules in liquid crystal cell in a bend form to hasten motion of the liquid crystal molecules is adopted, so that the response speed of liquid crystal can be improved to about 5 ms sufficiently shorter than one display field (16.7 ms).

The response speed of liquid crystal generally is defined as follows: In FIG. 12A, assuming that the state of luminance A (white) is 100% and the state of luminance B (black) is 0% in a change curve between the luminance A at the white display time and the luminance B at the black display time, the time required for changing from 10% to 90% at the rising time is rising time $\tau r$ and the time required for changing from 90% to 10% at the falling time is falling time $\tau d$.

On the other hand, various propositions are made to improve the problem of the hold display of the second cause. For example, a display for switching display of a liquid crystal panel for the duration of one display field to repeat a data screen and a black screen alternately is known (refer to JP-A-2001-42282 (the term "JP-A" as used herein means an "unexamined published Japanese patent application")). A liquid crystal display for detecting motion of an input image signal and continuing to light a backlight if the motion is less than a predetermined value or intermittently lighting the backlight if the motion is equal to or greater than the predetermined value (refer to JP-A-2002-091400) and a display for producing pseudo impulse display made close to impulse display by blinking a backlight (refer to JP-A-2001-268603) are devised. Particularly, if the black insertion time period during the duration of one display field is prolonged, display is made closer to impulse display, so that sensuous moving image display performance improves.

DISCLOSURE OF THE INVENTION

However, if the black insertion time period is prolonged, there is a side effect of degradation of the transmittance of a liquid crystal panel although the moving image display performance improves; the fact is that the black insertion time period cannot be set so long particularly in a large-screen TV requiring high display luminance. To overcome degradation of the transmittance of a liquid crystal panel, it is also possible to increase the luminance of a backlight for ensuring display luminance, but it is not preferred because it leads to waste of power consumption.

It is therefore an object of the invention to provide a liquid crystal display and a display method capable of ensuring sufficiently effective black insertion time and suppressing an increase in power consumption to execute pseudo impulse display for making black insertion during one display field time period to improve moving image display performance.

The purpose of the invention is accomplished by the following liquid crystal displays:

(1) According to a first aspect of the present invention, a liquid crystal display comprising: a liquid crystal panel; a backlight; an image move speed detection unit that detects the move speed of a display image, which is displayed on the liquid crystal panel; a black insertion percentage setting unit that sets black insertion percentage to produce black display according to liquid crystal response on the liquid crystal panel based on the move speed of the display image detected by the image move speed detection unit; and a backlight drive circuit that changes the luminance of the backlight in response to the black insertion percentage.

According to the liquid crystal display described above, the black insertion percentage setting unit sets the black insertion percentage of black display according to liquid crystal response based on the move speed of the display image detected by the image move speed detection unit and the backlight drive circuit changes the luminance of the backlight in response to the black insertion percentage, so that the moving image display characteristic is improved and degradation of the display luminance caused by black insertion can be suppressed.

(2) The liquid crystal display as described in the item (1), wherein, as the move speed of the display image becomes higher, the black insertion percentage according to the liquid crystal response is set to a higher value.

According to the liquid crystal display described above, if the move speed of the display image is high, the black insertion percentage according to the liquid crystal response is increased, so that even in an image at high move speed, occurrence of blurring at the moving image display time can be suppressed for displaying a good moving image.

(3) The liquid crystal display as described in the item (1), wherein, as the move speed of the display image becomes lower, the black insertion percentage according to the liquid crystal response is set to a lower value.

According to the liquid crystal display described above, if the move speed of the display image is low or the image is a still image, the black insertion percentage according to the liquid crystal response is decreased, so that degradation of the display luminance caused by black insertion is suppressed, power consumption of the backlight is suppressed, and a bright image can be displayed.

(4) The liquid crystal display as described in any one of the items (1) to (3), wherein the black insertion percentage according to the liquid crystal response and the luminance of the backlight are changed continuously or stepwise in response to the move speed of the display image.

According to the liquid crystal display described above, the black insertion percentage according to the liquid crystal response and the luminance of the backlight are changed continuously or stepwise in response to the move speed of the display image, so that a good moving image with no blurring and no display luminance change can always be displayed regardless of the move speed.

(5) According to a second aspect of the present invention, a liquid crystal display comprising: a liquid crystal panel; a backlight; an image move speed detection unit that detects the move speed of a display image displayed on the liquid crystal panel; a black insertion percentage setting unit that sets black insertion percentage to produce black display as the backlight is put out based on the move speed of the display image detected by the image move speed detection unit; and a backlight drive circuit for changing the maximum luminance of the backlight in response to the black insertion percentage.

According to the liquid crystal display described above, the black insertion percentage setting unit sets the black insertion percentage to produce black display as the backlight is put out based on the move speed of the display image detected by the image move speed detection unit and the maximum luminance of the backlight is changed in response to the black insertion percentage, so that the moving image display characteristic can be improved. Degradation of the display luminance caused by black insertion can be suppressed for displaying a good image.

(6) The liquid crystal display as described in the item (5), wherein, as the black insertion percentage in putting out the backlight becomes higher, the maximum luminance of the backlight is set to a higher value.

According to the liquid crystal display described above, if the black insertion percentage as the backlight is put out is high, the maximum luminance of the backlight is increased, so that degradation of the display luminance caused by black insertion can be compensated for and a bright image can always be displayed.

(7) The liquid crystal display as described in the item (5), wherein, as the black insertion percentage in putting out the backlight becomes lower, the maximum luminance of the backlight is set to a lower value.

According to the liquid crystal display described above, if the black insertion percentage as the backlight is put out is low, the maximum luminance of the backlight is decreased, so that power consumption of the backlight can be suppressed.

(8) The liquid crystal display as described in any one of the items (5) to (7), wherein the maximum luminance of the backlight is changed continuously or stepwise in response to the black insertion percentage as the backlight is put out.

According to the liquid crystal display described above, the maximum luminance of the backlight is changed continuously or stepwise in response to the black insertion percentage as the backlight is put out, so that a good image with no display luminance change can always be displayed regardless of the value of the black insertion percentage.

(9) The liquid crystal display as described in the item (4) or (8) wherein the luminance of predetermined gradation is substantially constant independently of the move speed of the display image.

According to the liquid crystal display described above, the luminance of predetermined gradation is almost constant independently of the move speed of the display image, so that a good image with no display luminance change can always be displayed.

The purpose of the invention is accomplished by the following methods of displaying:

(10) According to a third aspect of the present invention, a method of displaying a liquid crystal display comprising a liquid crystal panel and a backlight, wherein changing a black insertion percentage according to liquid crystal response based on the move speed of a display image detected, and changing a luminance of the backlight in response to the changing of the black insertion percentage.

According to the method of displaying the liquid crystal display described above, the black insertion percentage according to liquid crystal response is changed based on the move speed of a display image detected by the image move speed detection unit, and the luminance of the backlight is changed in response to the change of the black insertion percentage, so that the moving image display characteristic is improved, degradation of the display luminance caused by black insertion is suppressed, and a good image can be displayed.

(11) A method of displaying a liquid crystal display comprising a liquid crystal panel and a backlight, wherein changing a black insertion percentage to put out the backlight based on the move speed of a display image detected, and changing a maximum luminance of the backlight in response to the changing of the black insertion percentage.

According to the method of displaying the liquid crystal display described above, the black insertion percentage to put out the backlight is changed based on the move speed of a display image detected by the image move speed detection unit, and the maximum luminance of the backlight is changed in response to the change of the black insertion percentage, so that the moving image display characteristic is improved and a good image with less display luminance change can be displayed.

According to the invention, the black insertion percentage during one display field time period is set in response to the move speed of a display image and the luminance of the backlight is fluctuated in synchronization in response to fluctuations in the black insertion percentage, whereby the liquid crystal display having sufficient moving image display performance can be implemented while an increase in power consumption is suppressed to a small increase.

BRIEF DESCRIPTION OF THE DRAWINGS

The invention disclosed herein will be understood better with reference to the following drawings of which.

BEST MODE FOR CARRYING OUT THE INVENTION

Referring now to the accompanying drawings, there are shown preferred embodiments of the invention.

First Embodiment

Figure 1:
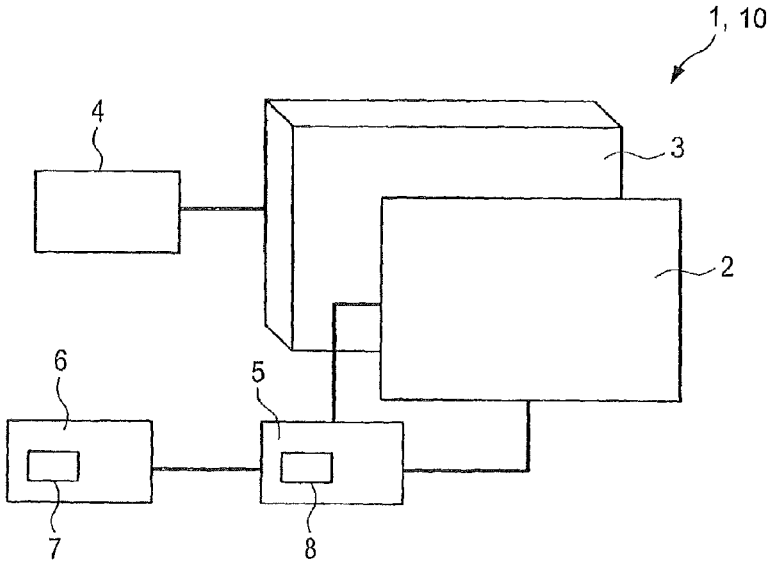
FIG. 1 is a drawing to show a schematic configuration of an image display for making black insertion according to a first embodiment of the invention.
Figure 2:
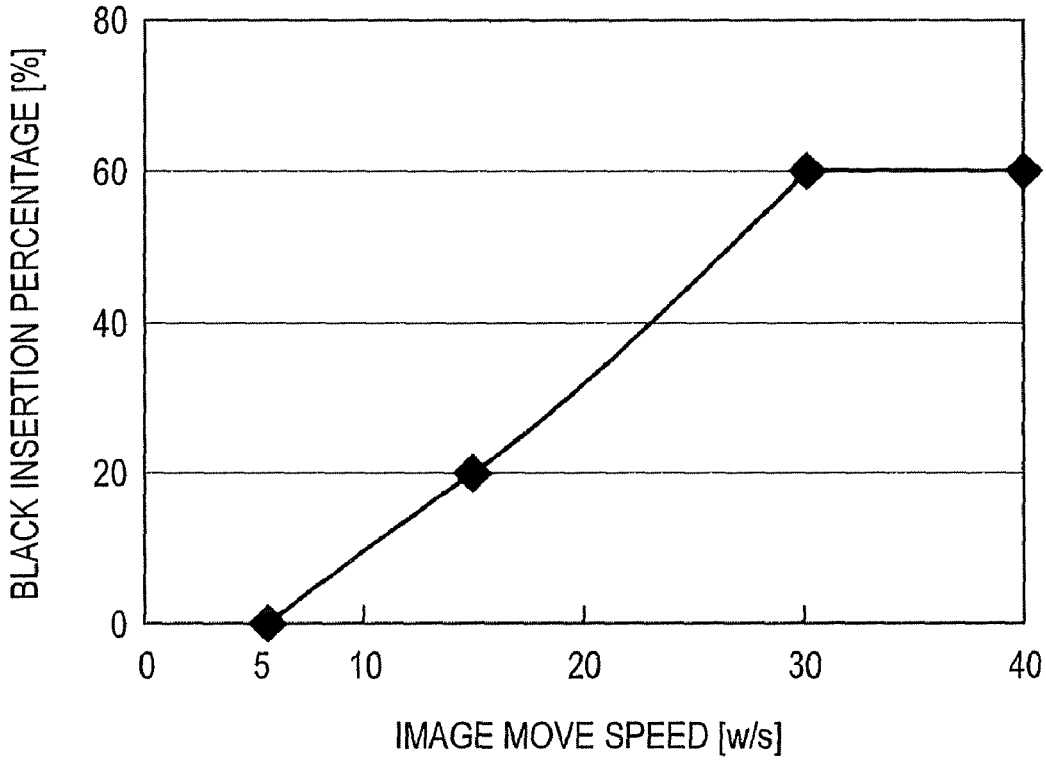
FIG. 2 is a graph to show the relationship between image move speed and black insertion percentage according to the first embodiment of the invention.
Figure 3:
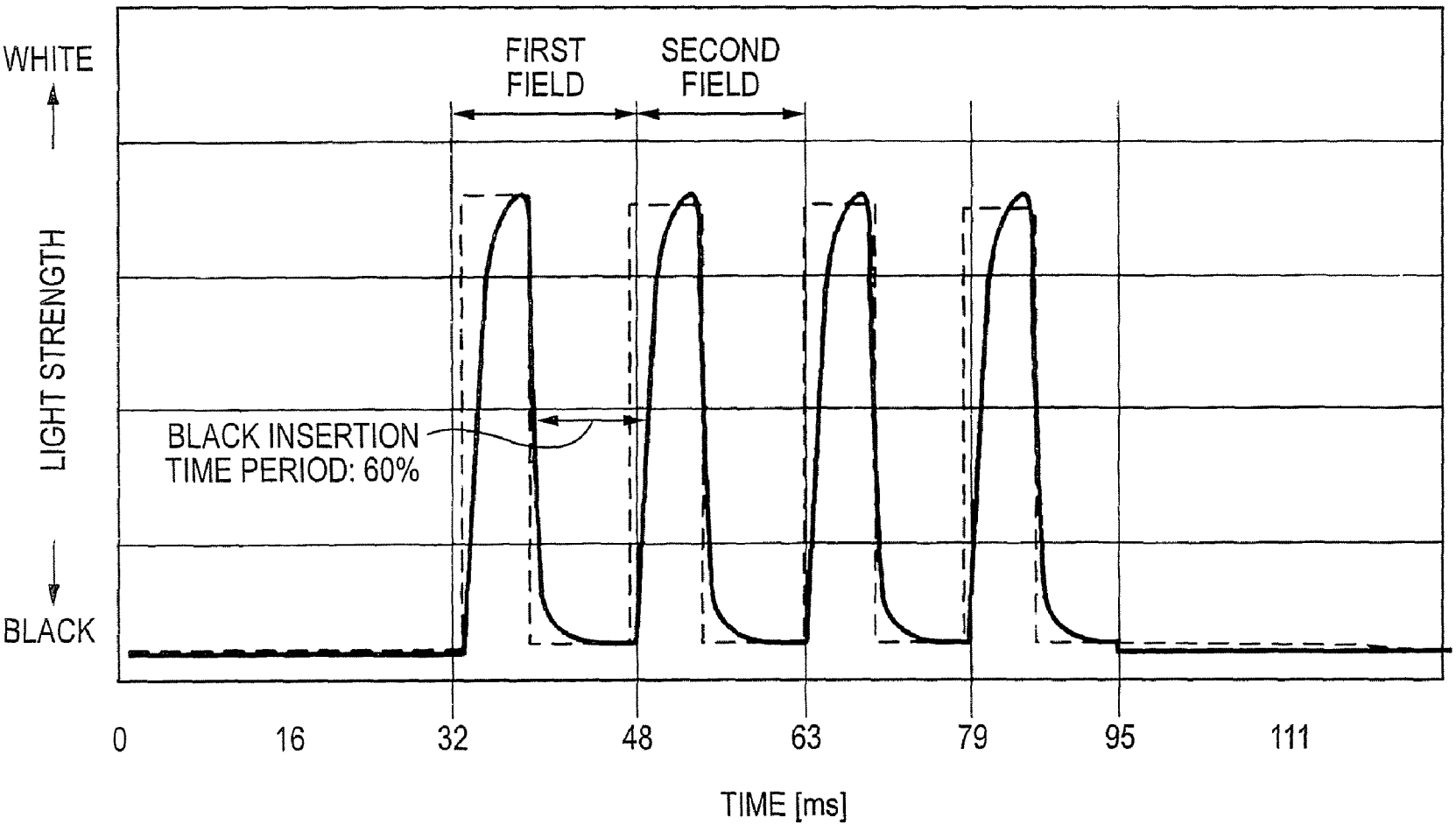
FIG. 3 is a graph to show a response waveform when 60% black insertion is made according to liquid crystal response according to the first embodiment of the invention.
Figure 4:
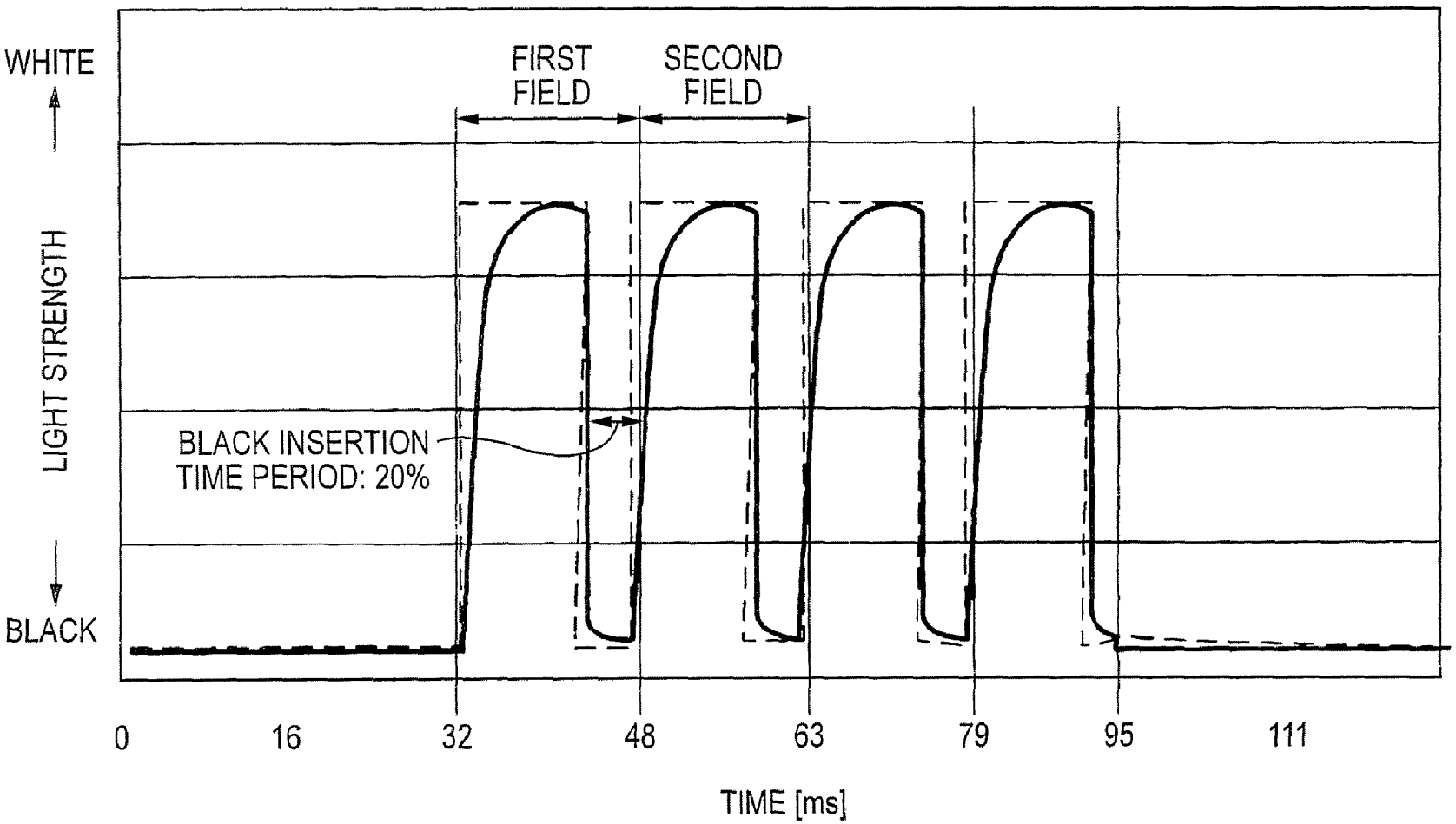
FIG. 4 is a graph to show a response waveform when 20% black insertion is made according to liquid crystal response according to the first embodiment of the invention.
Figure 5:
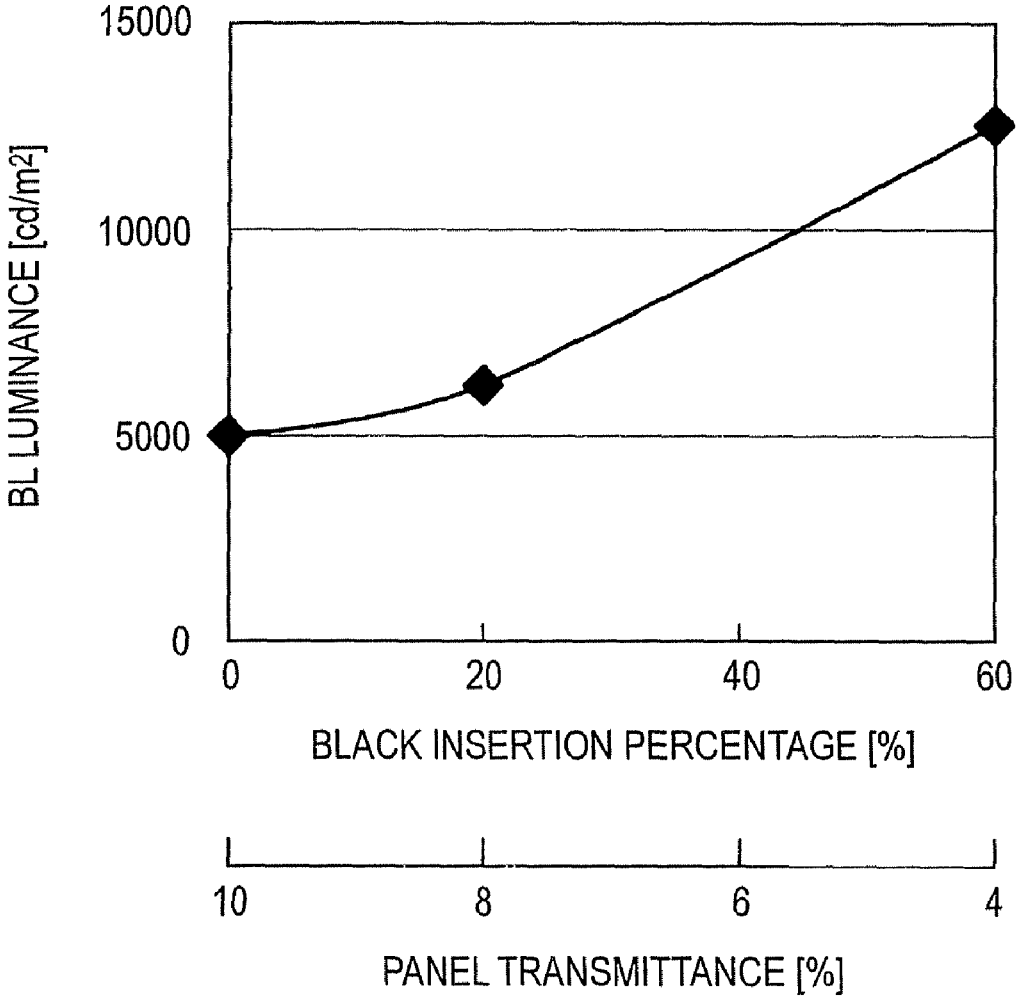
FIG. 5 is a graph to show the relationship among black insertion percentage and panel transmittance and backlight luminance according to the first embodiment of the invention.
Figure 6:
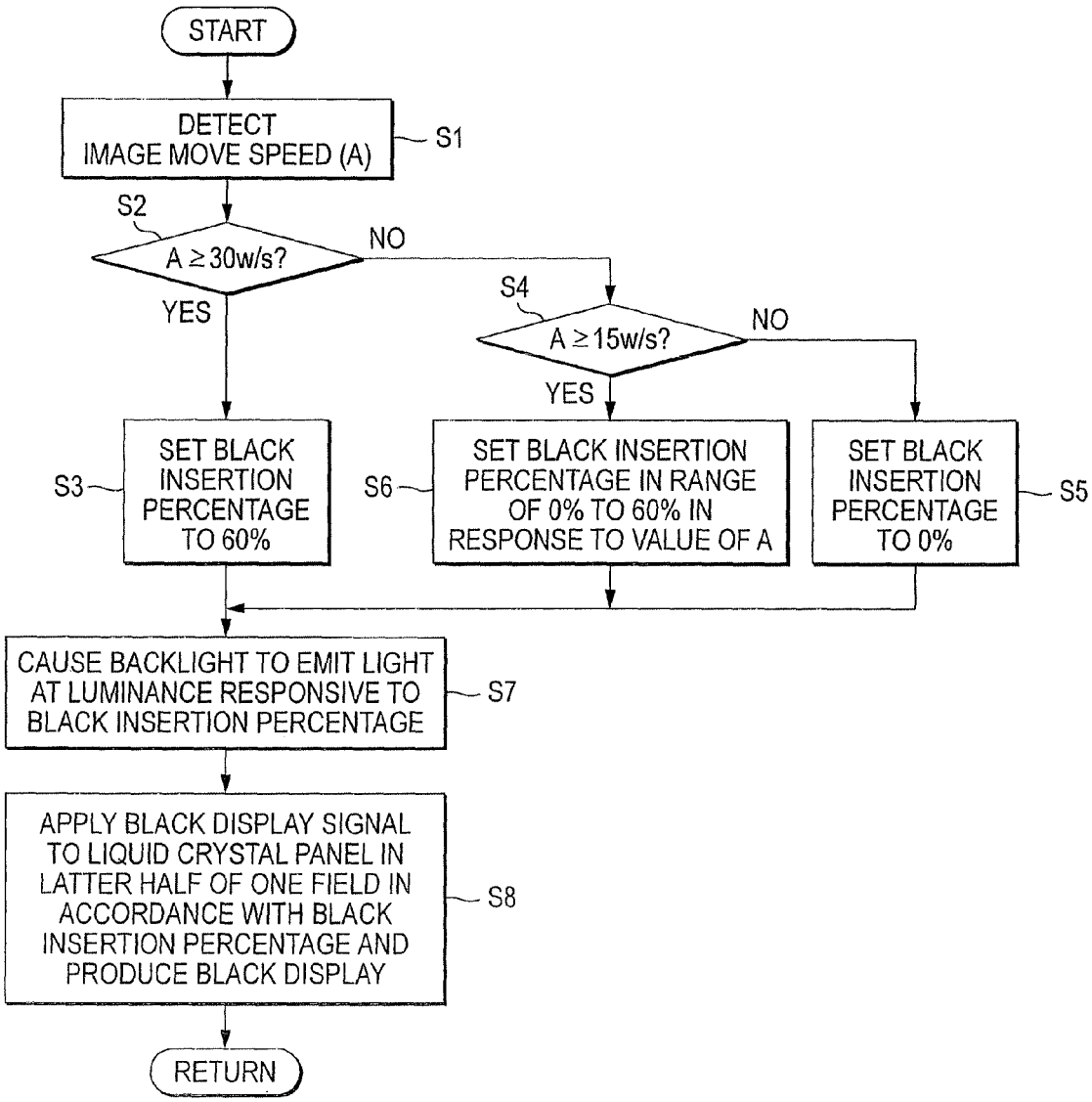
FIG. 6 is a flowchart to show a procedure of making black insertion according to liquid crystal response and displaying an image according to the first embodiment of the invention.

FIG. 1 is a drawing to show a schematic configuration of an image display (liquid crystal display) for making black insertion according to liquid crystal response, FIG. 2 is a graph to show the relationship between the image move speed and the black insertion percentage, FIG. 3 is a graph to show a response waveform when 60% black insertion is made according to liquid crystal response, FIG. 4 is a graph to show a response waveform when 20% black insertion is made according to liquid crystal response, FIG. 5 is a graph to show the relationship among the black insertion percentage and panel transmittance and backlight luminance, and FIG. 6 is a flowchart to show a procedure of making black insertion according to liquid crystal response and displaying an image.

As shown in FIG. 1, a liquid crystal image display 1 includes an active matrix liquid crystal panel 2 compatible with high-definition TV serving as an optical shutter by RGB light, a flat backlight 3 of a light source placed behind the liquid crystal panel 2, an inverter 4 of a backlight drive circuit for lighting the backlight 3, a panel drive circuit 5 for applying a signal to an electrode of the liquid crystal panel 2, and a signal processing circuit 6 for converting an external image signal into a drive signal of the liquid crystal panel 2.

The liquid crystal panel 2 is an OCB-mode liquid crystal panel wherein liquid crystal molecules form bend arrangement and the curvature of the bend changes with the magnitude of the applied voltage, whereby the produced gradation value is changed for producing display. The liquid crystal panel 2 has response characteristics of the rising response speed $\tau r$=4 ms and the falling response speed $\tau d$=1 ms. The drive frequency of the panel drive circuit 5 is 60 Hz and therefore one field time period is 16.6 ms.

The signal processing circuit 6 has a function of detecting not only the signal value for each pixel, but also the whole image as an image and has image move speed detection unit 7 for detecting change of an image relative to the time. The image change is separated into whole move, partial move, luminance change, image switching, etc.; in the embodiment, the image move speed for whole move, partial move is detected.

The image move speed mentioned here is used to mean the distance at which one rigid body moves during one frame time period. It corresponds to a size component in a motion vector contained in a signal encoded based on MPEG (Moving Picture Experts Group). If the whole image contains different motions, the image move speed varies from one position to another, but is represented as a representative value.

The panel drive circuit 5 has black insertion percentage setting unit 8 for setting the black insertion percentage for producing black display according to liquid crystal response on the liquid crystal panel 2 based on the image move speed detected by the image move speed detection unit 7.

The black insertion percentage is defined according to the following expression:

$$\text{Black insertion percentage} = \text{black insertion time period in one field/one field time period}$$

The black insertion time period is defined by a half-value width. (See FIGS. 3 and 4.)

The image display 1 applies a black display signal to the liquid crystal panel 2 in the latter half of one field so as to become the black insertion percentage set by the black insertion percentage setting unit 8 and produces black display on the liquid crystal panel 2. Accordingly, pseudo impulse display with a black display time period provided for the duration of one field is produced for improving the moving image characteristic. The inverter 4 changes the luminance of the backlight 3 in response to the black insertion percentage as described later.

Next, the operation of the image display 1 will be discussed based on a flowchart of FIG. 6. As shown in FIG. 6, first at step S1, the image move speed detection unit 7 detects the image move speed of an input signal and at step S2, whether or not the image move speed is equal to or greater than 30 w/s is determined. If the image move speed is equal to or greater than 30 w/s (YES), the black insertion percentage setting unit 8 sets the black insertion percentage to 60% at step S3. The term "w/s" unit the percentage of the screen width per second of move speed.

If it is not determined at step S2 that the image move speed is equal to or greater than 30 w/s (NO), whether or not the image move speed is equal to or greater than 5 w/s is determined at step S4. If the image move speed is less than 5 w/s (NO), the black insertion percentage is set to 0% at step S5. If the image move speed is equal to or greater than 5 w/s (YES), the black insertion percentage is set in the range of 0% to 60% in response to the image move speed at step S6.

Blurring of an image is roughly proportional to the image move speed. Therefore, the minimum black insertion percentage required for improving the image quality of a moving image is determined depending on the image move speed. The black insertion percentage is changed continuously in response to the image move speed as shown on the graph in FIG. 2.

That is, as the move speed of the display image becomes higher, the black insertion percentage according to the liquid crystal response is set to a higher value. On the other hand, as the move speed of the display image becomes lower, the black insertion percentage according to the liquid crystal response is set to a lower value. In addition, in a case where the image display is a still image, the black insertion percentage according to the liquid crystal response is set to a lower value.

The reason why the black insertion percentage is set to 0% constant when the image move speed is less than 5 w/s is that blurring of an image does not introduce a problem if the image move speed is less than 5 w/s. In so doing, a decrease in brightness of the image by making black insertion can be prevented.

The reason why the black insertion percentage is set to 60% constant when the image move speed is equal to or greater than 30 w/s is that eyes of a human being fail to follow motion of an image and blurring becomes unannoying if the image move speed is equal to or greater than 30 w/s. Since the transmittance of the liquid crystal panel changes with the black insertion percentage, in the embodiment, the maximum value of the black insertion percentage is set to 60%. In so doing, a decrease in brightness of the image by making black insertion can be suppressed.

Next, at step S7, the backlight 3 is caused to emit light at the luminance determined based on the black insertion percentage as shown in FIG. 5. The transmittance of the liquid crystal panel 2 changes in roughly inverse proportion to the black insertion percentage as shown along with the horizontal axis in FIG. 5. The luminance of the backlight 3 is changed continuously in response to the black insertion percentage and the backlight 3 is caused to emit light at high luminance as the black insertion percentage increases, thereby making up for degradation of the transmittance of the liquid crystal panel 2.

That is, the transmittance of the liquid crystal panel 2 is multiplied by the backlight luminance, thereby finding the luminance of the image display 1 at the white display time. In the embodiment shown in FIG. 5, setting is made so as to become roughly 500 candelas constant regardless of the image move speed. Luminance adjustment of the backlight 3 is controlled by changing the inverter voltage.

At step S8, a black display signal is applied to the liquid crystal panel 2 in the latter half of one field so as to become the black insertion percentage found according to the graph of FIG. 2 and black display is produced on the liquid crystal panel 2 for producing pseudo impulse display.

FIGS. 3 and 4 show the response waveforms of the liquid crystal panel at the white display time as display is produced as described above (the figures show the case where white display is produced for the duration of a four-field time period in black display). The applied signal to the liquid crystal panel 2 is represented by a dashed line and the liquid crystal response waveform is represented by a solid line. FIG. 3 shows the waveform generated when the image move speed is comparatively high as 30% of the screen width per second (30 w/s) and the black insertion percentage is set to 60%. FIG. 4 shows the waveform generated when the image move speed is comparatively low as 15% of the screen width per second (15 w/s) and the black insertion percentage is set to 20%. If the image move speed is 5% of the screen width per second (5 w/s) or less, the image is determined a still image and the black insertion percentage is set to 0%.

According to the liquid crystal panel 2 described above, it has been confirmed that if a video signal of high-definition TV is input and video fast in motion is displayed, blurring of the moving image is scarcely recognized and moving image display performance equal to that of a CRT is provided. On the other hand, power consumption a little increases because of partial rise of the inverter voltage of the backlight 3, but was power consumption almost equal to that of a conventional liquid crystal display in general video comparatively slow in motion.

If overdrive of applying a compensation voltage for improving the response speed or the like is applied, the waveform of an applied signal a little differs from that in the embodiment, but the advantage of the invention is equal.

As described above, the method of displaying the liquid crystal display of the embodiment is the method of displaying the liquid crystal display 1 including the liquid crystal panel 2 and the backlight 3, wherein the black insertion percentage according to liquid crystal response is changed based on the move speed of the display image detected by the image move speed detection unit 7, and the luminance of the backlight 3 is changed in response to the change of the black insertion percentage.

In the above-mentioned example, the black insertion percentage according to the liquid crystal response and the luminance of the backlight are changed continuously or stepwise in response to the move speed of the display image. However, a scope of the present invention is not limited by the above-mentioned example. For example, the move speed of the display image is divided into plural ranges, and then different value of the black insertion percentage or the luminance of the backlight may be set in each of the plural ranges. As mentioned above, The black insertion percentage according to the liquid crystal response and the luminance of the backlight are changed stepwise in response to the move speed of the display image so that a display control is simplified. In addition, in a case where the display control is performed at high speed, the liquid crystal can respond easily and certainly.

Second Embodiment

Figure 7:
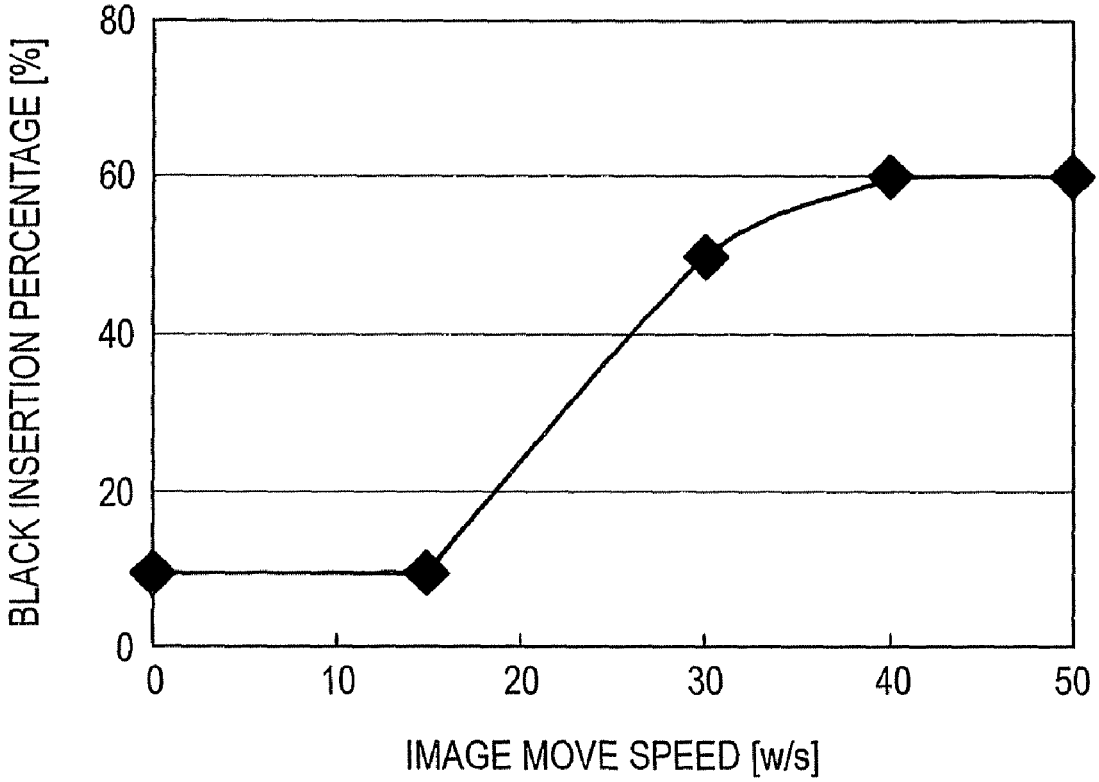
FIG. 7 is a graph to show the relationship between image move speed and black insertion percentage according to a second embodiment of the invention.
Figure 8:
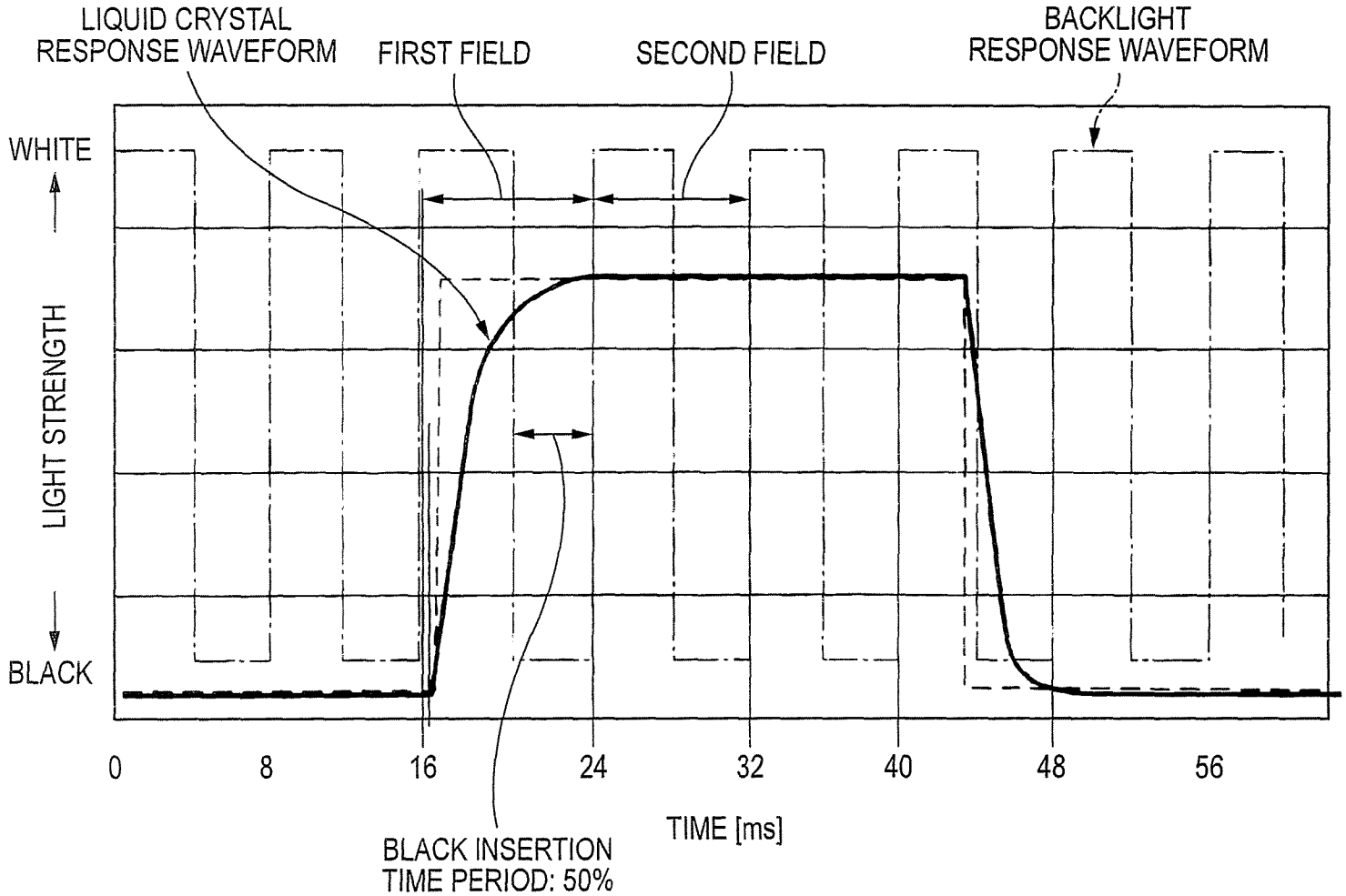
FIG. 8 is a graph to show a response waveform when 50% black insertion is made as a backlight is put out according to the second embodiment of the invention.
Figure 9:
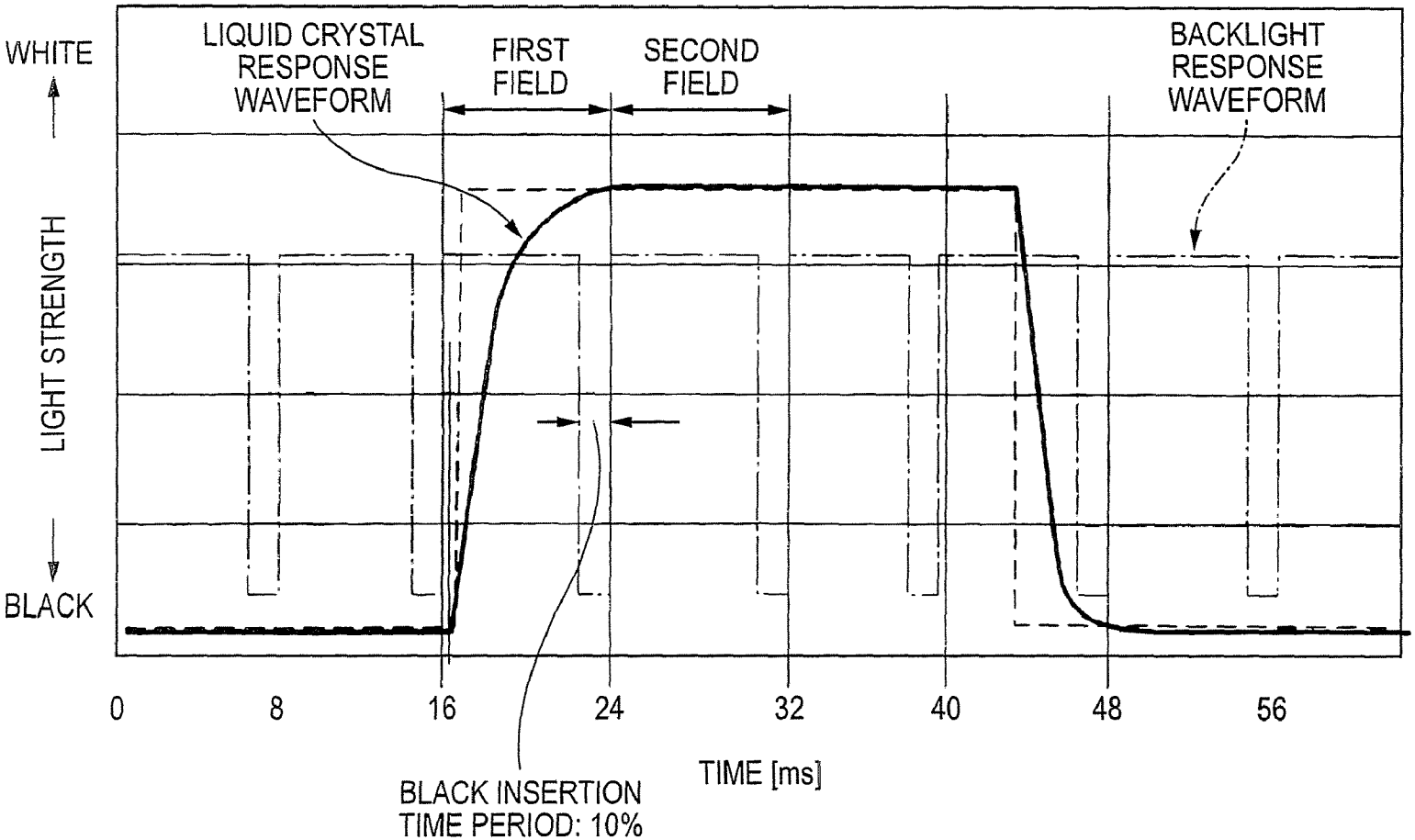
FIG. 9 is a graph to show a response waveform when 10% black insertion is made as the backlight is put out according to the second embodiment of the invention.
Figure 10:
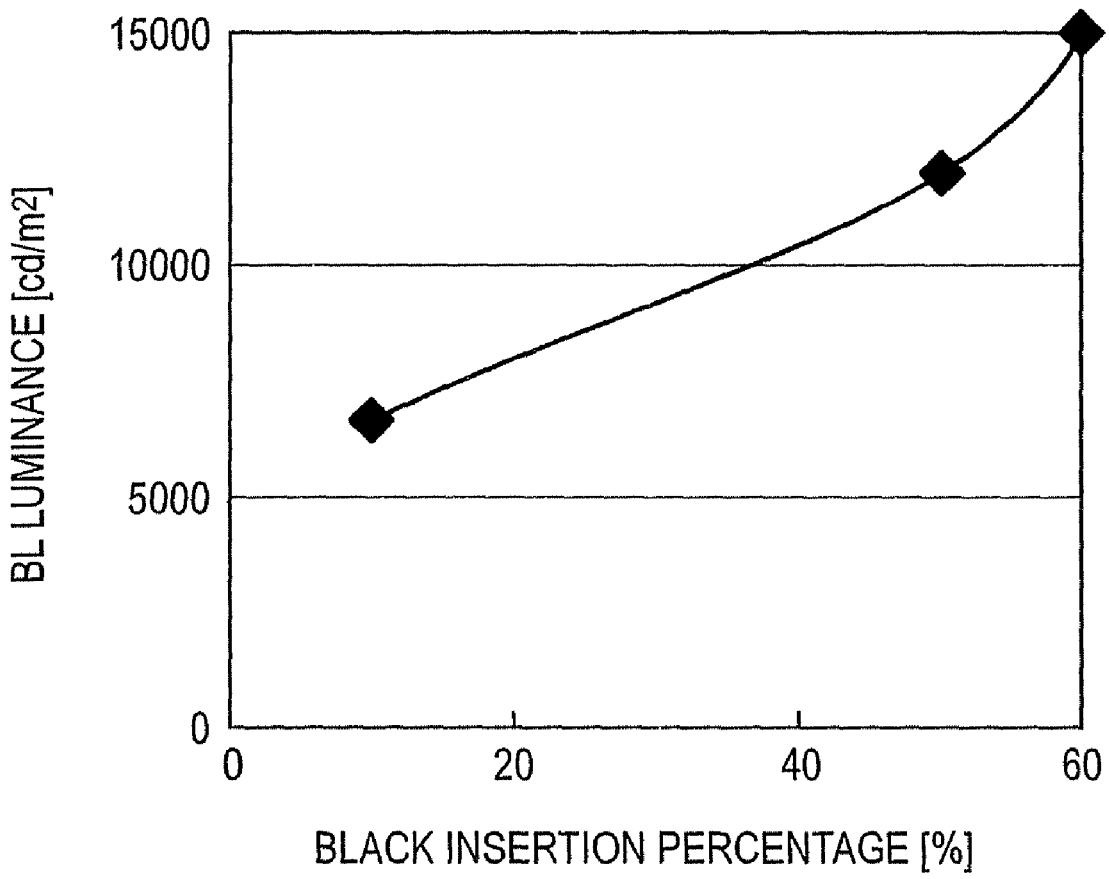
FIG. 10 is a graph to show the relationship between the black insertion percentage and the maximum luminance of the backlight according to the second embodiment of the invention.
Figure 11:
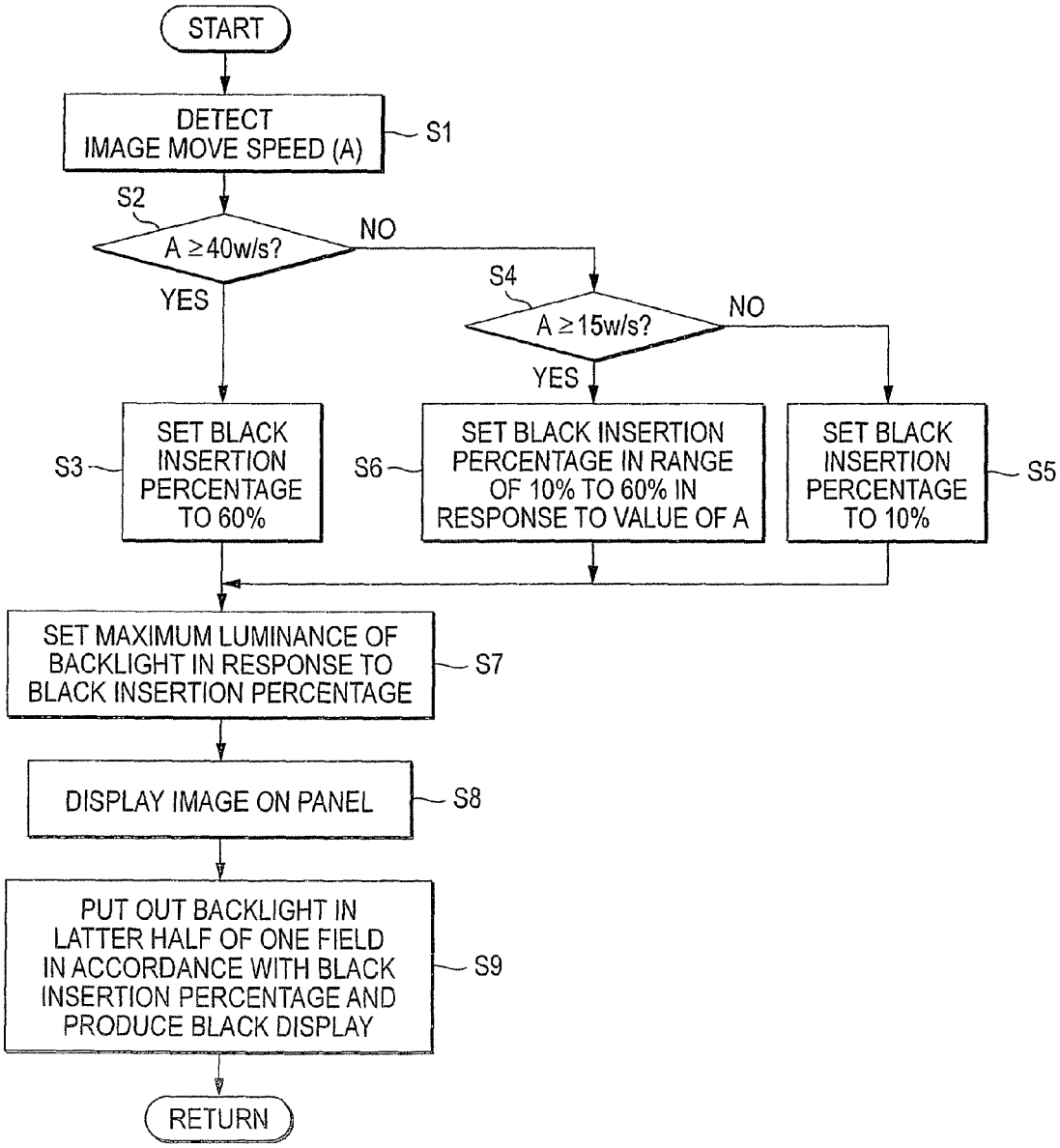
FIG. 11 is a flowchart to show a procedure of making black insertion as the backlight is put out and displaying an image according to the second embodiment of the invention.
Figure 12A:
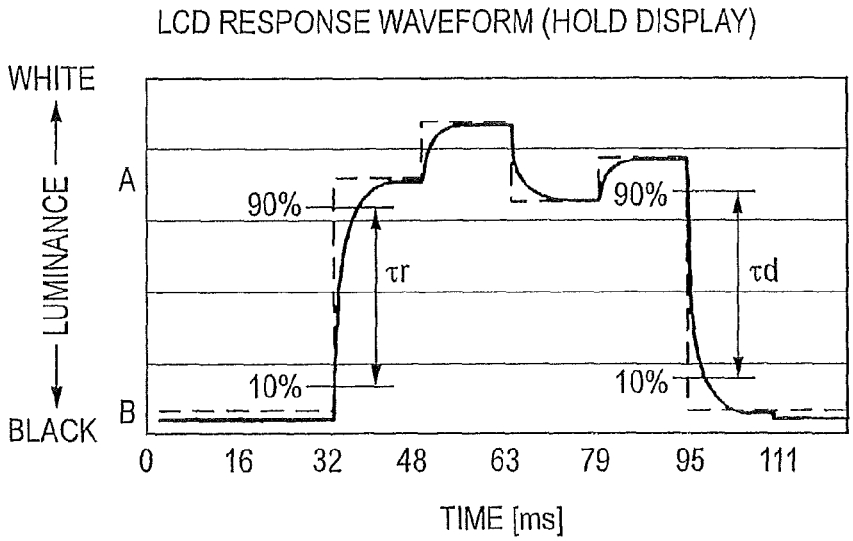
FIG. 12 A shows a response waveform of a general liquid crystal panel and FIG. 12 B shows a response waveform of a general CRT.
Figure 12B:
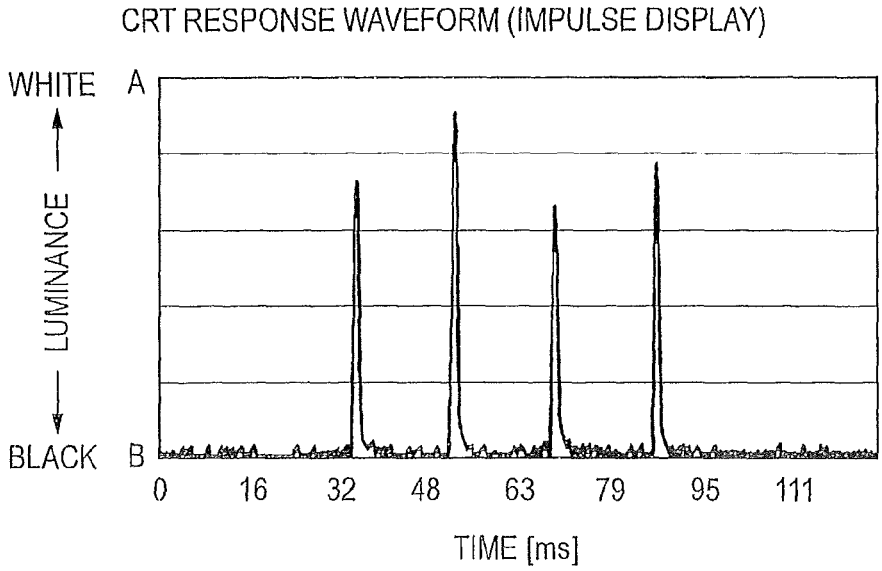
PRIOR ART FIG. 12B

Next, an image display 10 of a second embodiment will be discussed based on FIGS. 7 to 11. FIG. 7 is a graph to show the relationship between image move speed and black insertion percentage, FIG. 8 is a graph to show a response waveform when 50% black insertion is made as a backlight is put out, FIG. 9 is a graph to show a response waveform when 10% black insertion is made as the backlight is put out, FIG. 10 is a graph to show the relationship between the black insertion percentage and the maximum luminance of the backlight, and FIG. 11 is a flowchart to show a procedure of making black insertion as the backlight is put out and displaying an image.

The image display 10 of the second embodiment has a similar configuration to that of the image display 1 of the first embodiment shown in FIG. 1 and therefore FIG. 1 is used in the description to follow. The configurations and the functions of image move speed detection unit 7 and black insertion percentage setting unit 8 are similar to those of the image display 1 of the first embodiment and therefore will not be discussed again. The image move speed and the black insertion percentage are also defined like those in the first embodiment. An inverter 4 changes the maximum luminance of a backlight 3 in response to the black insertion percentage. Intermittent lighting of the backlight 3 is controlled in response to the black insertion percentage.

A liquid crystal panel 2 of the second embodiment is a TN (twist nematic) liquid crystal panel wherein liquid crystal molecules are placed in twist arrangement and rise according to the magnitude of an applied voltage, thereby producing display. The drive frequency of a panel drive circuit 5 of the image display 10 of the embodiment is 120 Hz. Therefore, one field time period is 8.3 ms.

The image display 10 puts out the backlight 3 in the latter half of one field so as to become the black insertion percentage set by the black insertion percentage setting unit 8 and produces black display on the liquid crystal panel 2. Accordingly, pseudo impulse display with a black display time period provided for the duration of one field is produced for improving the moving image characteristic. The inverter 4 changes the maximum luminance of the backlight 3 in response to the black insertion percentage.

Next, the operation of the image display 10 will be discussed in detail based on a flowchart of FIG. 11. As shown in FIG. 11, first at step S1, the image move speed detection unit 7 detects the image move speed of an input signal and at step S2, whether or not the image move speed is equal to or greater than 40 w/s is determined. If the image move speed is equal to or greater than 40 w/s (YES), the black insertion percentage setting unit 8 sets the black insertion percentage to 60% at step S3.

If it is not determined at step S2 that the image move speed is equal to or greater than 40 w/s (NO), whether or not the image move speed is equal to or greater than 15 w/s is determined at step S4. If the image move speed is less than 15 w/s (NO), the black insertion percentage is set to 10% at step S5. If the image move speed is equal to or greater than 15 w/s (YES), the black insertion percentage is set in the range of 10% to 60% in accordance with the characteristic curve shown in FIG. 7 determined in response to the image move speed at step S6.

The black insertion percentage is changed continuously in response to the image move speed as shown on the graph in FIG. 7. The reason why the black insertion percentage is set to 10% constant when the image move speed is less than 15 w/s and the reason why the black insertion percentage is set to 60% constant when the image move speed is equal to or greater than 40 w/s are similar to those with the image display 1 of the first embodiment.

Next, at step S7, the maximum luminance of the backlight 3 is set based on the relationship with the black insertion percentage shown in FIG. 10 for compensating for the display luminance of the liquid crystal display changed (degraded) according to the black insertion percentage. The maximum luminance of the backlight 3 is changed continuously in response to the black insertion percentage.

That is, as the black insertion percentage in putting out the backlight becomes higher, the maximum luminance of the backlight is set to a higher value. On the other hand, as the black insertion percentage in putting out the backlight becomes lower, the maximum luminance of the backlight is set to a lower value.

The luminance is set to the maximum luminance shown in FIG. 10, whereby the display luminance at the white display time can be set to roughly 600 candelas constant regardless of the image move speed. Maximum luminance adjustment of the backlight 3 is controlled by changing the inverter voltage.

At step S8, an image is displayed on the liquid crystal panel 2 and the backlight 3 is put out in the latter half of one field so as to become the black insertion percentage set at step S9 and black display is produced. Accordingly, pseudo impulse display with a black display time period provided for the duration of one field is produced.

FIGS. 8 and 9 show the response waveforms of the liquid crystal panel at the white display time as display is produced as described above (the figures show the case where white display is produced for the duration of a four-field time period in black display). The applied signal to the liquid crystal panel 2 is represented by a dashed line, the liquid crystal response waveform is represented by a solid line, and the light emission waveform of the backlight is represented by an alternate long and short dash line. FIG. 8 shows the waveform generated when the image move speed is comparatively high as 30% of the screen width per second and the black insertion percentage as the backlight 3 is put out is set to 50%.

FIG. 9 shows the waveform generated when the image move speed is comparatively low as 15% of the screen width per second and the black insertion percentage is set to 10%. In the embodiment, the lowest black insertion percentage is set to 10% and even in a still image, the black insertion percentage is set to 10%. As seen in FIGS. 8 and 9, the maximum luminance of the backlight 3 is changed continuously in response to the black insertion percentage as the backlight 3 is put out, as shown in the graph in FIG. 10.

It has been confirmed that the moving image display performance and the power consumption of the image display 10 of the embodiment are equal to those of the image display 1 of the first embodiment. If overdrive of applying a compensation voltage for improving the response speed or the like is applied, the waveform of an applied signal a little differs from that in the embodiment, but the advantage of the invention is equal.

As described above, the method of displaying the liquid crystal display 10 of the embodiment is the method of displaying the liquid crystal display including the liquid crystal panel 2 and the backlight 3, wherein the black insertion percentage to put out the backlight 3 for producing black display is changed based on the move speed of the display image detected by the image move speed detection unit 7, and the maximum luminance of the backlight 3 is changed in response to the change of the black insertion percentage.

In the above-mentioned example, according to the black insertion percentage to put out the backlight 3 for producing black display, the maximum luminance of the backlight 3 is changed continuously. However, a scope of the present invention is not limited by the above-mentioned example. For example, the black insertion percentage is divided into plural ranges, and then different value of the maximum luminance of the backlight may be set in each of the plural ranges. As mentioned above, the maximum luminance of the backlight is changed stepwise in response to the black insertion percentage so that a display control is simplified. In addition, in a case where the display control is performed at high speed, the liquid crystal can respond easily and certainly.

The invention claimed is:

1. A liquid crystal display comprising:

a liquid crystal panel;

a backlight;

an image move speed detection unit that detects the move speed of a display image, which is displayed on the liquid crystal panel;

a black insertion percentage setting unit that sets black insertion percentage to produce black display according to liquid crystal response on the liquid crystal panel based on the move speed of the display image detected by the image move speed detection unit; and a backlight drive circuit that changes the luminance of the backlight in response to the black insertion percentage.

2. The liquid crystal display as claimed in claim 1, wherein, as the move speed of the display image becomes higher, the black insertion percentage according to the liquid crystal response is set to a higher value.

3. The liquid crystal display as claimed in claim 1, wherein, as the move speed of the display image becomes lower, the black insertion percentage according to the liquid crystal response is set to a lower value.

4. The liquid crystal display as claimed in claim 1, wherein the black insertion percentage according to the liquid crystal response and the luminance of the backlight are changed continuously or stepwise in response to the move speed of the display image.

5. A liquid crystal display comprising:

a liquid crystal panel;

a backlight;

an image move speed detection unit that detects the move speed of a display image displayed on the liquid crystal panel;

a black insertion percentage setting unit that sets black insertion percentage to produce black display as the backlight is put out based on the move speed of the display image detected by the image move speed detection unit; and a backlight drive circuit for changing the maximum luminance of the backlight in response to the black insertion percentage.

6. The liquid crystal display as claimed in claim 5, wherein, as the black insertion percentage in putting out the backlight becomes higher, the maximum luminance of the backlight is set to a higher value.

7. The liquid crystal display as claimed in claim 5, wherein, as the black insertion percentage in putting out the backlight becomes lower, the maximum luminance of the backlight is set to a lower value.

8. The liquid crystal display as claimed in claim 5, wherein the maximum luminance of the backlight is changed continuously or stepwise in response to the black insertion percentage as the backlight is put out.

9. The liquid crystal display as claimed in claim 4, wherein the luminance of predetermined gradation is substantially constant independently of the move speed of the display image.

10. A method of displaying a liquid crystal display comprising a liquid crystal panel and a backlight, wherein the method comprises the steps of changing a black insertion percentage according to liquid crystal response based on the move speed of a display image detected, and changing a luminance of the backlight in response to the changing of the black insertion percentage.

11. A method of displaying a liquid crystal display comprising a liquid crystal panel and a backlight, wherein the method comprises the steps of changing a black insertion percentage to put out the backlight based on the move speed of a display image detected, and changing a maximum luminance of the backlight in response to the changing of the black insertion percentage.

12. The liquid crystal display device as claimed in claim 8, wherein the luminance of predetermined gradation is substantially constant independently of the move speed of the display image.

* * * * *